US006100460A

United States Patent [19]

Hoshino

[11] Patent Number: 6,100,460

[45] Date of Patent: Aug. 8, 2000

[54] CONNECTION BETWEEN THE PEDAL PLATE AND THE HEEL PLATE OF A FOOT PEDAL

[75] Inventor: Yoshihiro Hoshino, Nagoya, Japan

[73] Assignee: Hoshino Gakki Co., Ltd., Japan

[21] Appl. No.: 09/369,396

[22] Filed: Aug. 6, 1999

[30] Foreign Application Priority Data

Jan. 21, 1999 [JP] Japan ..... 11-013118

[51] Int. Cl.[7] ..... G10D 13/02

[52] U.S. Cl. ..... 84/422.1; 84/422.2

[58] Field of Search ..... 84/422.1, 422.2, 84/422.3

[56] References Cited

U.S. PATENT DOCUMENTS 5,421,234 6/1995 Liao ..... 84/422.1

*Primary Examiner*—Stanley J. Witkowski
*Assistant Examiner*—Shih-yung Hsieh

[57] ABSTRACT

A pedal for a musical instrument, or the like, includes a pedal plate and a heel plate that are pivotable with respect to each other. An axle extends between axle insertion holes in the heel plate and extends axially outward into axle receiving holes in the pedal plate. A tightening screw at the heel plate is tightened down on the axle for preventing upward and downward movement. A holder which is tightened into the heel plate has a tapered surface for urging the axle forwardly for preventing forward and rearward movement. At each axle receiving hole in the pedal plate, for holding the axle against axial movement, a sliding bearing around the axle is received in a collar inside the receiving opening. The sliding bearing is tightened into the collar squashing an O-ring between the collar and the sliding bearing which prevents axial movement of the axle.

8 Claims, 8 Drawing Sheets

CONNECTION BETWEEN THE PEDAL PLATE AND THE HEEL PLATE OF A FOOT PEDAL

BACKGROUND OF THE INVENTION

The present invention relates to a connecting part between a pedal plate and a heel plate of a foot pedal for operating musical instruments like a drum or cymbal, etc.

A foot pedal of a musical instrument is used during a performance for instance, for swinging the beater that beats the drum or by moving an operating rod of a high hat cymbal up and down.

As is shown in the prior art pedal of FIG. 7, this kind of foot pedal F1 comprises a pedal plate 100 which operates the beater or the operating rod for the performance of the musical instrument and the ground part or heel plate, which is connected to the rear of the pedal plate.

It is desirable for the foot pedal F1 to operate smoothly, without any sluggishness. For this purpose, the axle 300 is in axially spaced apart axle insertion holes 230 in the heel plate 200. A fixing nut 450 fixes the axle to the heel plate 200 by fixing screws 250. The axle 300 is held freely rotatably on the pedal plate 100 through a ball bearing 400 in axial receiving holes in the axle holder 130 of the pedal plate, as shown in FIGS. 7 and 8. There is a connector 110 at the free end of the pedal plate for connections to the operating part of the musical instrument (not shown). The axle holder 130 of the pedal plate 100 holds the axle. A nut 170 and a screw 160 respectively holding the bearing 400 to the axle holder.

This ball bearing structure, however, enables a movable angular range of the pedal plate 100 of the foot pedal F1 of at most approximately 10 degrees during a performance. In this case, the load of the rotation is concentrated at all times on a limited few of the ball bearings 400 (either one or two when the angle is approximately 10 degrees), despite the fact that the original purpose of the ball bearing 400 is to disperse the load over all of the balls that are stored and that receive the rotation of the axle 300.

The ball bearing 400 that can be used at the connection between the pedal plate 100 and the heel plate 200 of the foot pedal F1, in particular, is limited to a small size due to space and performance requirements. This concentrates the operating load on an extremely small part, thereby making it possible that the ball bearing 400 will break.

In addition, it is possible to obtain smooth operation by using such a construction of the connection. Because of this, however, that part for the escape of the force that is thereby applied disappears. This places a large burden not only on the ball bearing 400, but also on the fixed screw 250 that supports the axle 300 and on the axle 300 itself. As a result, bending or damage that may be inflicted on the axle 300 and the fixing screw 250 becomes a problem.

To solve such a problem, it becomes necessary to increase the strength not only of the ball bearing 400 but also of the various elements of the connection. As described above, however, various elements in this kind of foot pedal structures are of small size. Moreover, the loads that are applied to the various elements are different, depending upon the operation and strength of the performers, thereby making it extremely difficult to drastically improve the situation with this construction.

SUMMARY OF THE INVENTION

Under the circumstances, the object of this invention is to provide a connection between the pedal plate and the heel plate in a foot pedal which is capable of offering stable durability while offering smooth operation.

The invention relates to a connection between the pedal plate and the heel plate of a foot pedal wherein both ends of an axle which has been fixed in the axle insertion hole of the heel plate are held at the axle holes of the pedal plate and the pedal plate is freely rotatably connected to the heel plate and the axle is held against up and down, first and rear and axial motions.

In the axle insertion hole of the heel plate, the axle is pressed downward by a fixing screw that presses downward on the top of the axle, while the axle is also pressed by a holder that has a tapered pressing surface that applies pressure from the rear of the axle in the forward direction. The axle is held in the axle insertion hole to eliminate gaps in the hole which gaps are located in the top and bottom and in the front and back directions of the axle. In the axle holes of the pedal plate, the axle is held against axial direction shifting by a sliding bearing that has an inside step and that has been inserted inside of a collar having an outside step. The collar is compressively held by the axle holder thorough an O-ring on the inside step. That O-ring is in opposition to the axle holder at its step.

Other objects and features of the invention are explained with reference to the attached drawings.

DESCRIPTION OF THE PREFERRED EMBODIMENTS

Figure 1:
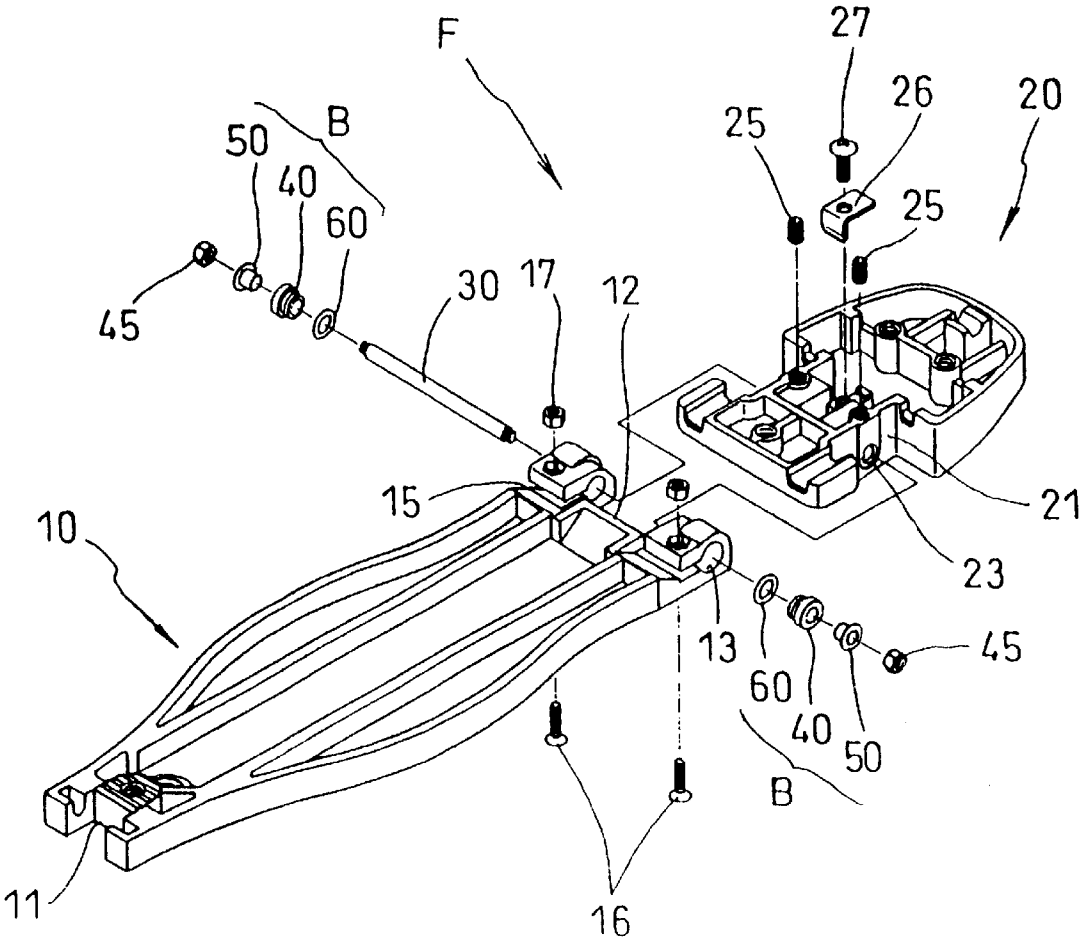
FIG. 1 PRIOR ART
FIG. 1 is an oblique view of a pedal plate and a heel plate of a foot pedal according to an embodiment of this invention.

The foot pedal F shown in FIG. 1 operates a drum beater of conventional design, which is used for playing a musical instrument drum, or for moving a cymbal, etc. The foot pedal F includes a front pedal plate 10 that is the operating part for operating an operating prod (not shown) of a musical instrument (not shown). A heel plate 20, which is the ground part, is connected to the rear portion of the pedal plate. The pedal plate is connected with an operating part on the side of an instrument.

To link the pedal plate 10, which is movable, and the heel plate 20, which is fixed, there is a cut-out or concave 12 at the rear of the pedal plate 10. The front region of the heel plate 20 just behind its front has a laterally narrowed linkage concave 21 which is inserted ito the concave 12 at the rear of the pedal plate. The axle 30 is fixed in the axle insertion holes 23 of the heel plate 20, and the ends of the axle are held in the axle holding holes 13 of the pedal plate 10. The axle 30 freely swingably connects the pedal plate 10 to the heel plate 20.

Figure 2:
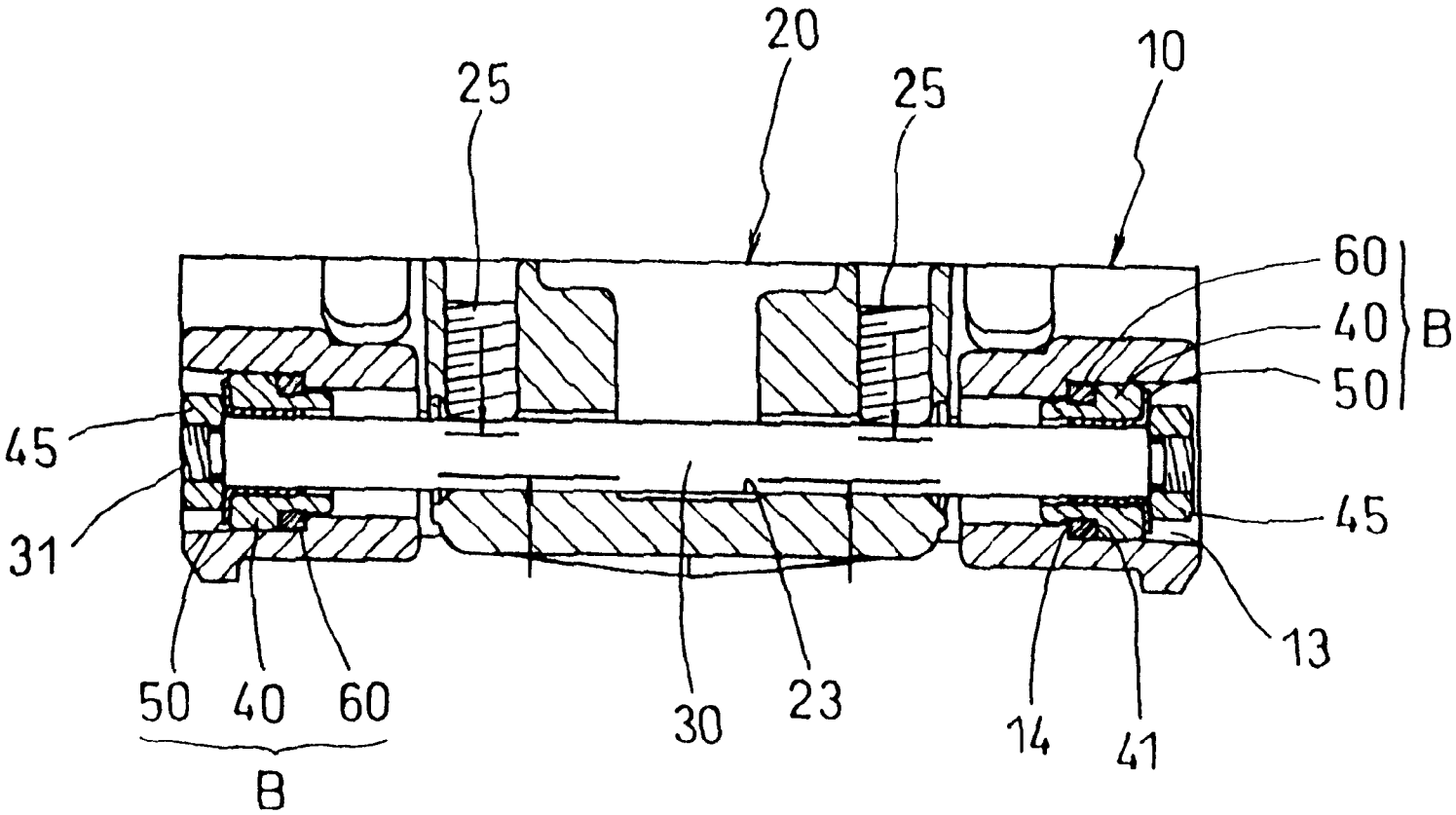
FIG. 2 is a transverse cross section through an essential part of the foot pedal showing the connection between the pedal plate and the heel plate.

The axle 30 is pressed down upon by the axially spaced apart fixing screws 25, which apply downward pressure on the top of the axle 30 in the axial insertion hole 23 of the heel plate 20, as shown in FIG. 2. At the same time, a holder 26 shown in FIG. 3, has a front surface that applies pressure toward the forward direction from the rear of the axle 30. This combination fixes and holds the axle 30 in the axle insertion hole 23 so as to eliminate gaps in the up and down directions and in the forward and rearward directions of the axle 30, as shown in FIG. 3.

The fixing screw 25 preferably has a head that does not protrude from the top surface of the heel plate 20, as shown in FIG. 2. More stable affixation is possible when the distance between the two fixed screws 25 is made larger.

Figure 3:
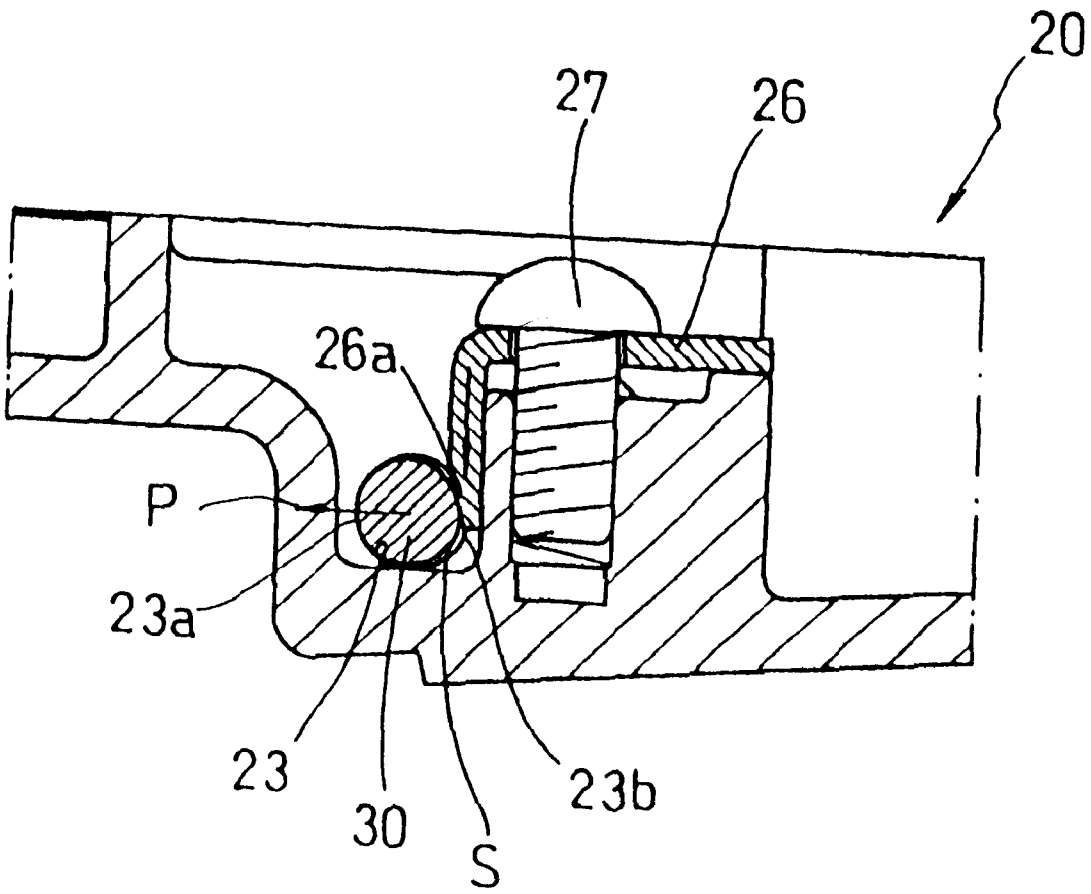
FIG. 3 is a vertical section of that connection in the length direction of the foot pedal showing the holder for the axle in the heel plate.
Figure 4:
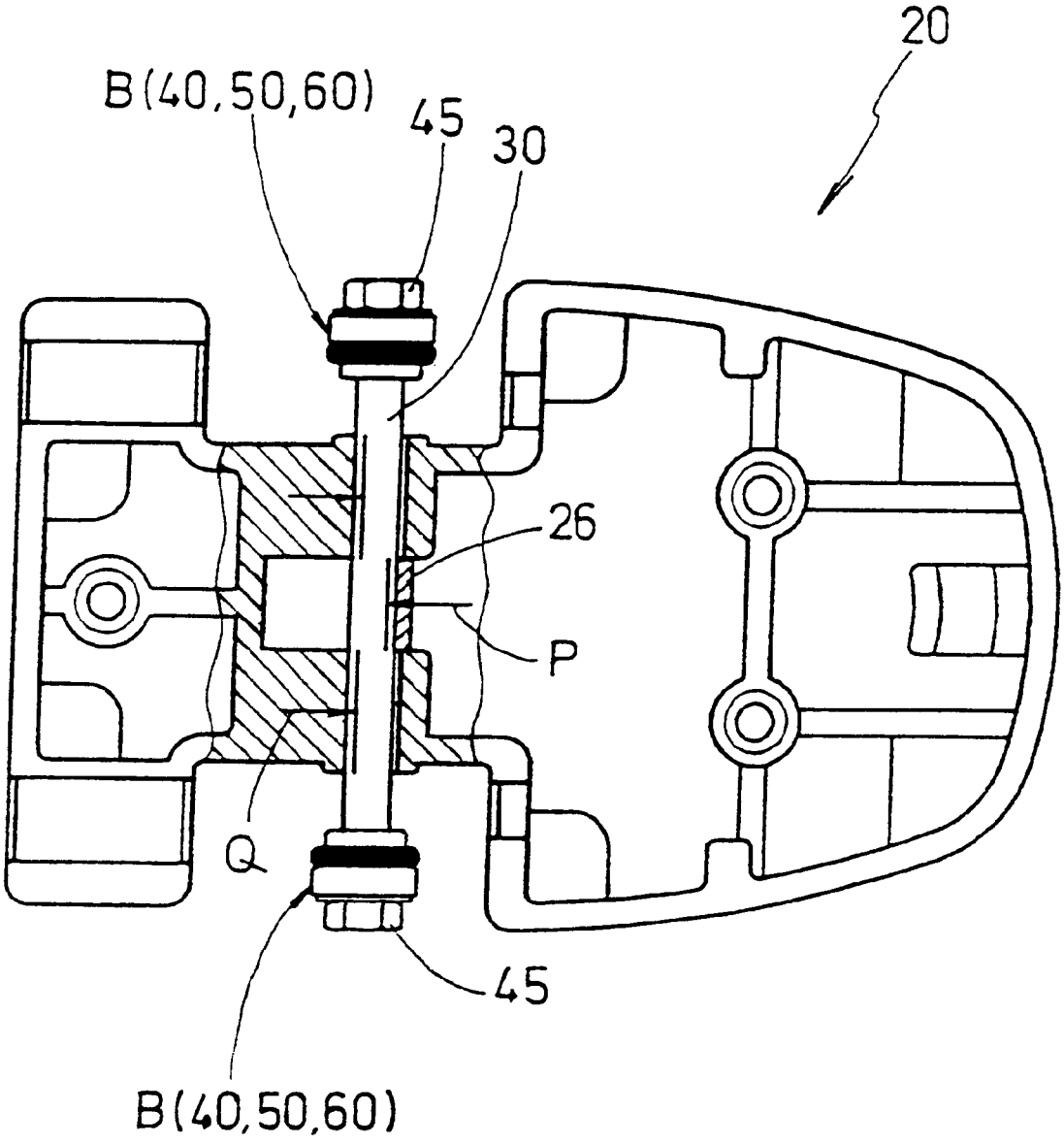
FIG. 4 is a plan view, in partial, cross section, of the connection.

As seen in FIGS. 3 and 4, the holder 26 has an L-shaped cross section and has a tapered, forward facing, pressing surface 26*a*. The holder is tightened to the heel plate 20 by a fixing screw 27 subsequent to arranging the axle 30 in the axle insertion hole 23. The holder presses the axle 30 out in the direction indicated in FIG. 3 and presses the axle to the front edge 23*a* of the axle insertion hole 23 for fixing the axle.

In FIG. 3, a gap S is created on the rear edge 23*b* of the axial insertion hole 23 by the holder 26. The arrow Q in FIG. 4 indicates a repulsive force that is applied by the side of the heel plate 20 to the axle 30.

The axle 30 is held axially at the axle holders 13 of the pedal plate 10 by a slide bearing 50 that is inserted inside a collar 40. The collar has an outside step 41 as shown in FIG. 2. The collar 40 is compressively held in the axle receiving hole in the axle holder 13 through an O-ring 60 on the opposing inside step 14 of the holes 13, and the O-ring engages the collar 40 at its opposing outside step 41.

Each axle holes 13 as shown in FIG. 1, has an approximate cross-sectional C shape including a groove 15. A bolt 16 from below and a nut 17 from above are tightened together at the groove 15, compressively tightening holes 13 around the collar 40.

Figure 5:
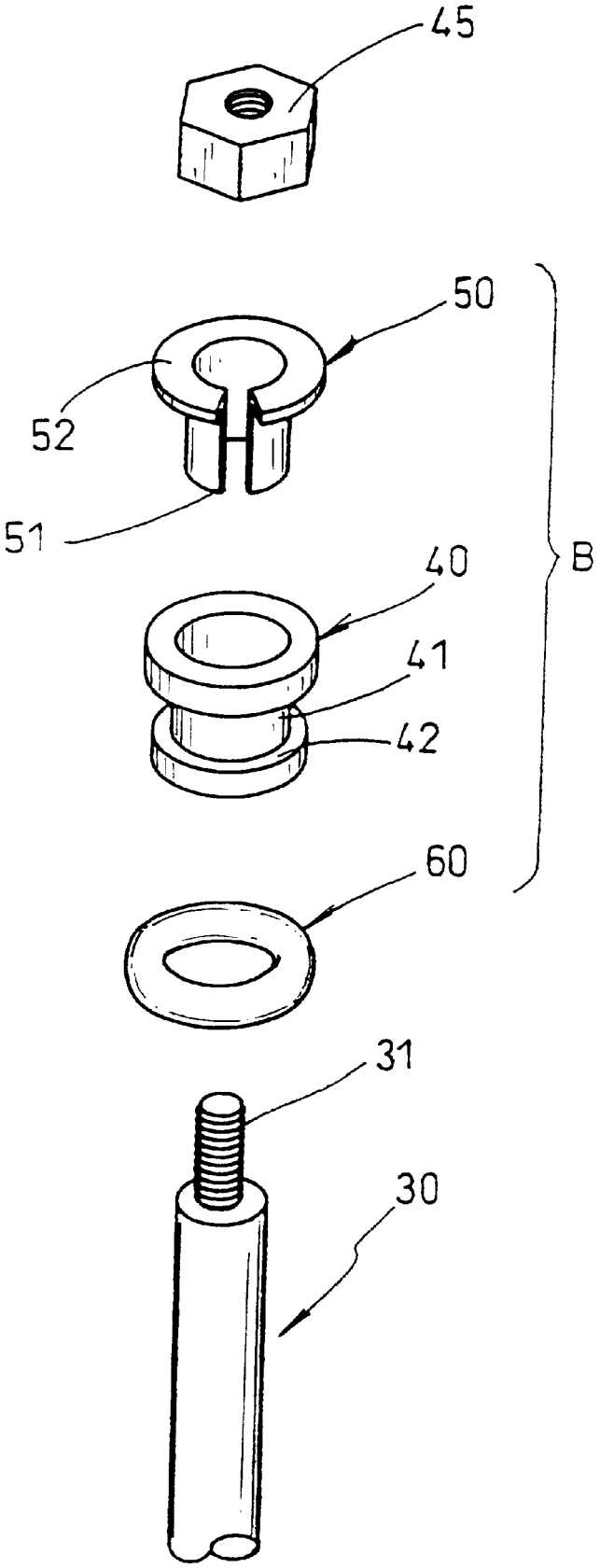
FIG. 5 is an oblique and exploded view showing the various elements that are installed on the axle holder of the pedal plate.

FIG. 5 shows the various members installed at the axle holes 13. A holding flange for the O-ring 60 is provided at the outside step 41 of the collar member 40.

The sliding bearing 50 is a tubular body having a groove 51 over its full axial height, allowing it to be clamped around the axle. The bearing 50 has a flange 52 for installation at one side. The sliding bearing 50 is stronger than a ball bearing as the latter only holds point contact while the sliding bearing maintains surface contact with the axle 30. The sliding bearing 50 may be made of a metal or a plastic, etc. as are known. Here, metal mesh is suggested as the base material, and the inside and the surface are coated with ethylene tetrafluoride resin containing a filler having abrasion resistance.

Such a sliding bearing structure exhibits high abrasion resistance and load resistance, where operational stoppage takes place frequently because of the low speed swinging movement and alternating motion or where a high load may be added instantaneously as with the foot pedal F of this invention.

An O-ring 60 is provided on the outside step 41 of the collar 40. The slide bearing 50 is inserted into the collar. The bearing is inwardly tightened into the collar by a tightening nut 45 tightened on threads 31 at both ends of the axle 30. As a result, the O-ring 60 on the inside step 14 of the axle holes 13 of the pedal plate 10 is squashed, and the repulsive force of the squashed O-ring 60 supplies compressive force with which the slide bearing 50 is pressed against the tightening nut 45, thereby eliminating shakiness in the axial direction.

Figure 6:
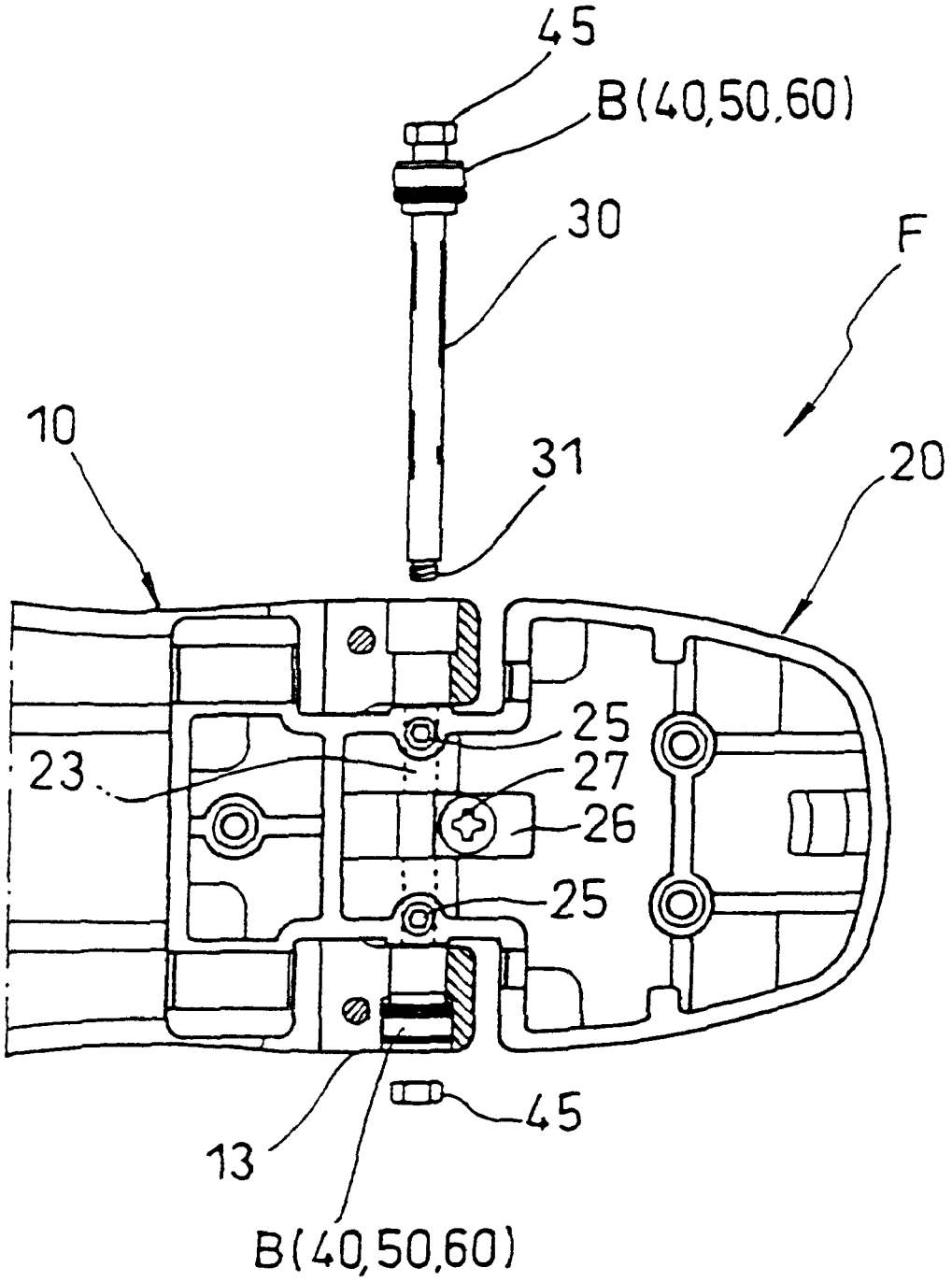
FIG. 6 shows the assembly of the axle.
Figure 7:
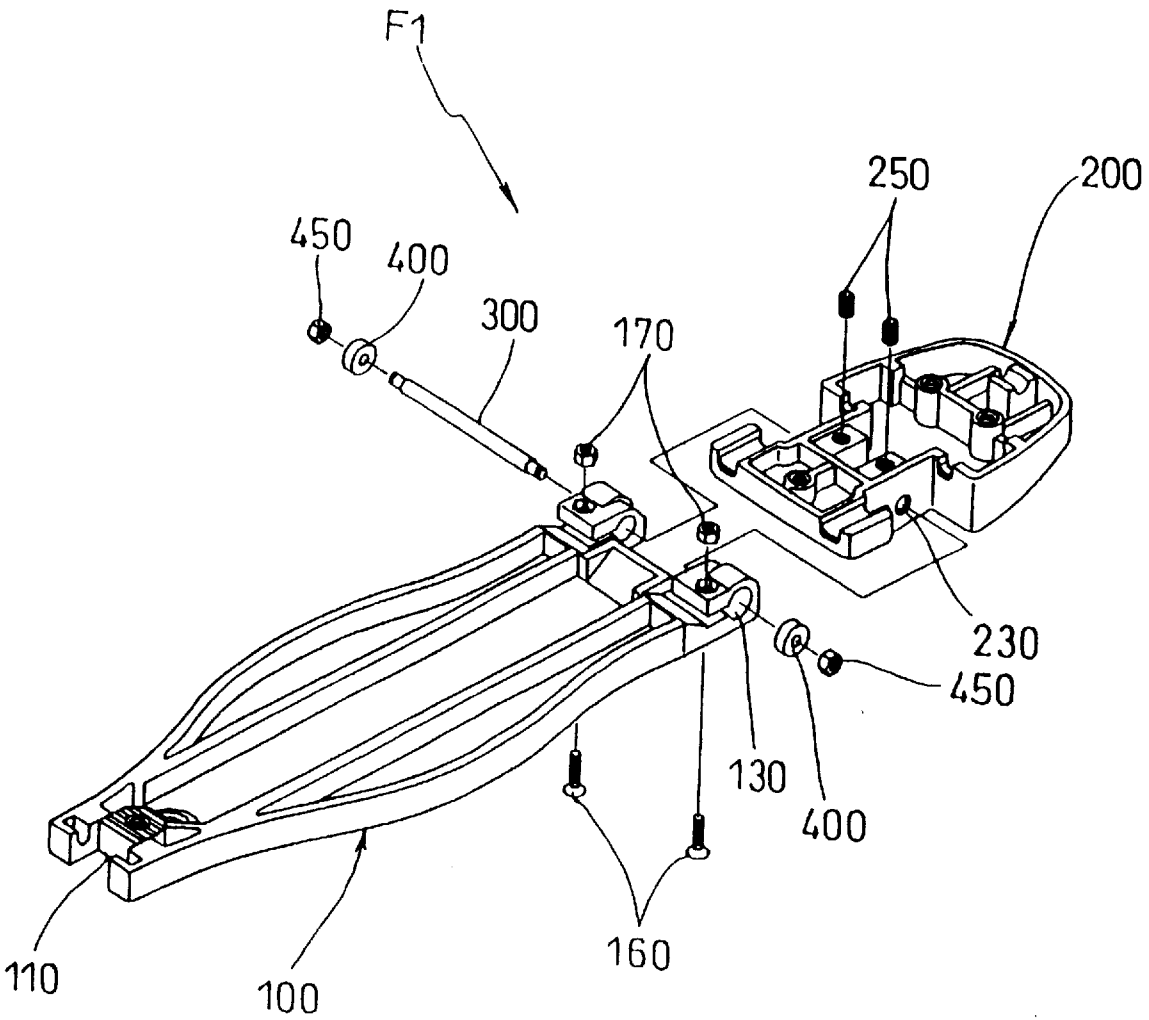
FIG. 7 is an oblique view of the connection between the pedal plate and the heel plate, employing a ball bearing and being according to the prior art.
Figure 8:
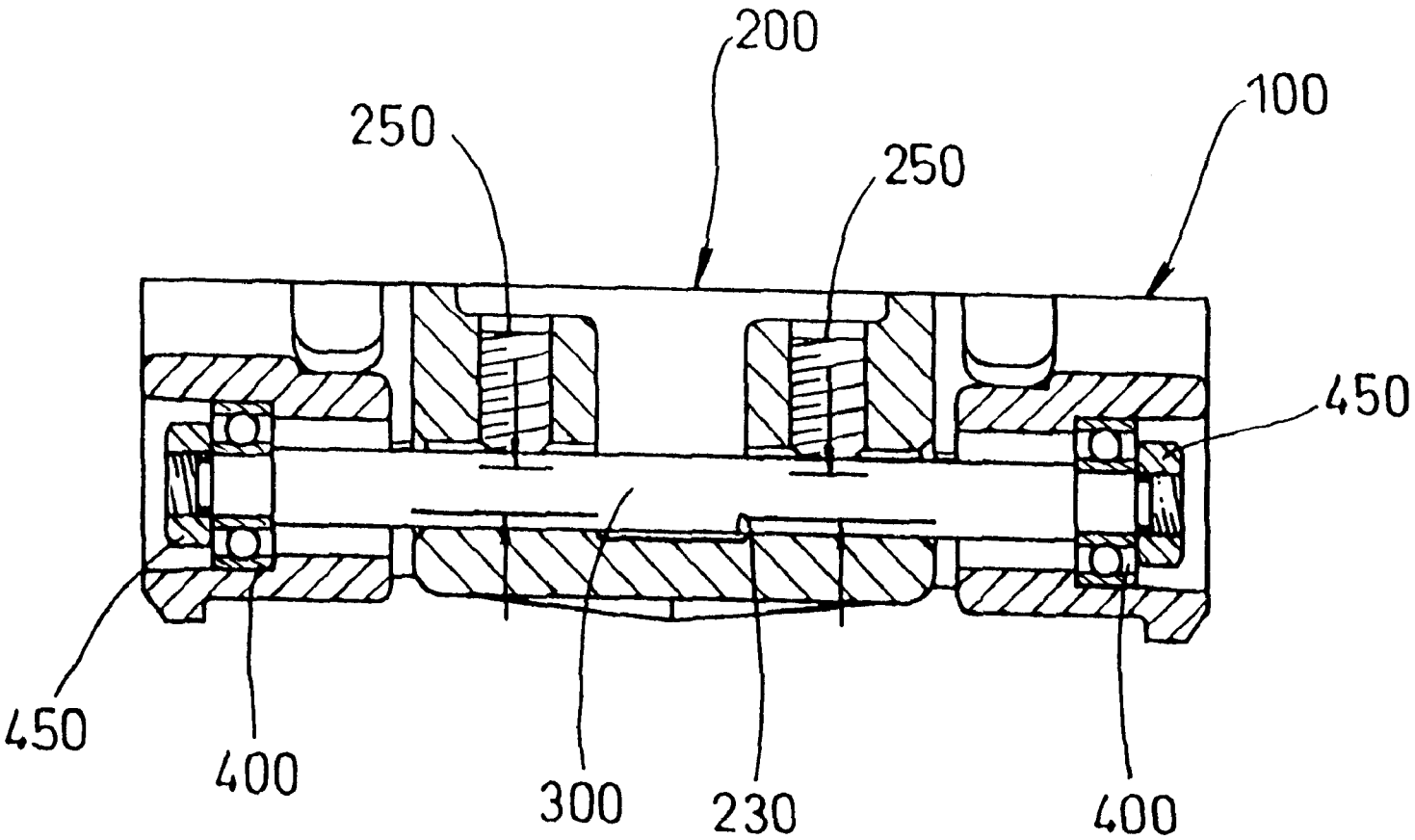
FIG. 8 PRIOR ART
FIG. 8 is a cross section of the essential part of the link in FIG. 7.

Next, combining of the axle 30 with the heel plate 20 and the pedal plate 10 is explained. First, the collar 40, the slide bearing 50 and the O-ring 60 are assembled as a bearing assembly with the bearing in the collar as shown in FIG. 6. One such bearing assembly B is assembled with the tightening nut 45 on one end of the axle 30. This desirably improves operation. Another bearing assembly B is arranged at the axle holes 13 on the opposite side to the axle insertion side of the pedal plate 10.

Next, the axle 30 is inserted into the axle holes 13 of the pedal plate 10 and into the axle insertion hole 23 of the heel plate 20. The tightening nut 45 is screwed through one of the bearing assemblies B. At the same time, the tightening nuts 45 at both ends of the axle 30 are tightened, thereby setting the position of the axle in the axial direction. Next, the holder 26 is installed, the holder fixing screw 27 is tightened, and the axle 30 is thereby pressed in the forward direction in the axle insertion hole 23 by the tapered pressing surface 26*a*.

When the positions of the axle in the axial direction and in the forward and rearward directions have been fixed in this manner, the up and down directions of the axle 30 are fixed from above by the fixing screws 25. As a result, the axle 30 is pressed from three directions, completely fixing it.

The connection between the pedal plate and the heel plate of the foot pedal firmly fixes and holds the axle with a fixing screw and a holder in the axle insertion hole of the heel plate and holds the pedal plate by the collar, the slide bearing and the O-ring at the axle holder of the pedal plate, with rotation permitted by the slide bearing. Smooth operation without shakiness is obtained. At the same time, stable durability can be provided.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A connecting structure of a foot pedal between a pedal plate and a heel plate of the foot pedal, enabling the plates to pivot relative to one another at the connecting structure, the connecting structure comprising:

the heel plate having first and second pivot axle insertion holes spaced apart from each other across the width of the heel plate;

a pivot axle passing through and extending axially outward of both axle insertion holes;

an axle fixing element in the heel plate and operable to press down on the axle supported in the axle insertion holes;

a holder disposed behind the axle at the heel plate, the holder including a pressing surface that presses from behind the axle and pushes the axle forward, whereby the fixing screw and the holder eliminate gaps above and below and forward and rearward of the axle in the heel plate;

the pedal plate including a respective axle receiving hole located axially outward of each axle insertion hole so that the axle may extend through the axle insertion holes of the heel plate into the axle receiving holes of the pedal plate, whereby the pedal plate and the heel plate may pivot relatively around the axle;

axial motion inhibiting elements in the pedal plate at the axle receiving holes for preventing the axle shifting axially with respect to the pedal plate.

2. The structure of claim 1, wherein the axle fixing element comprises an axle fixing screw received in the heel plate and tightenable to press down on the axle.

3. The structure of claim 1, wherein the axial movement inhibiting elements at each axle receiving hole of the pedal plate comprise a collar around the axle, and the pedal plate axle receiving hole being of a size for pressing on the collar; and a sliding bearing inside the collar and over the axle for permitting pivoting of the pedal plate with respect to the heel plate.

4. The structure of claim 3, further comprising an axially outwardly facing step on the collar, an axially inwardly facing step on the sliding bearing and located axially outwardly of and opposing the outwardly facing step; and an O-ring disposed between the opposing steps, such that when the bearing is urged axially inwardly, it squashes the O-ring for making a motion preventing connection between the sliding bearing and the collar.

5. The structure of claim 4, further comprising a tightening element for axially tightening the sliding bearing into the collar and squashing the O-ring.

6. The structure of claim 5, wherein the axle has axial ends that are threaded and the tightening element comprises a respective nut tightened on the threaded end of the axle for tightening the respective sliding bearings into the collars.

7. The structure of claim 1, wherein the holder pressing surface has a taper that faces toward the axle, and the taper is shaped so that as the holder is tightened into the heel plate, the tapered pressing surface urges the axle forward.

8. The structure of claim 7, further comprising a holder tightening element for the holder for tightening the holder into the heel plate.

* * * * *